US010811852B2

(12) United States Patent
Watanabe

(10) Patent No.: US 10,811,852 B2
(45) Date of Patent: Oct. 20, 2020

(54) SPARK PLUG AND RESISTOR MATERIAL FOR SPARK PLUG

(71) Applicant: DENSO CORPORATION, Kariya, Aichi-pref. (JP)

(72) Inventor: Tomoyuki Watanabe, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/571,250

(22) Filed: Sep. 16, 2019

(65) Prior Publication Data

US 2020/0091685 A1 Mar. 19, 2020

(30) Foreign Application Priority Data

Sep. 17, 2018 (JP) ..... 2018-173158

(51) Int. Cl.

| | |
|---|---|
| ***H01T 13/41*** | (2006.01) |
| ***H01T 1/16*** | (2006.01) |
| ***H01C 7/108*** | (2006.01) |
| ***H01T 13/34*** | (2006.01) |

(52) U.S. Cl.

CPC ..... *H01T 13/41* (2013.01); *H01C 7/108* (2013.01); *H01T 1/16* (2013.01); *H01T 13/34* (2013.01)

(58) Field of Classification Search

CPC ..... H01T 13/41
USPC ..... 313/141
See application file for complete search history.

(56) References Cited

U.S. PATENT DOCUMENTS 2,591,205 A * 4/1952 Schoenlaub ..... C04B 37/025 174/152 S
2011/0204766 A1 8/2011 Yoshida et al.

* cited by examiner

*Primary Examiner* — Christopher M Raabe
(74) *Attorney, Agent, or Firm* — Nixon & Vanderhye, P.C.

(57) ABSTRACT

A spark plug which is capable of further improving load life performance and a resistor material for a spark plug are provided.

A spark plug includes a center electrode, a terminal fitting, and a resistor disposed between the center electrode and the terminal fitting. The resistor contains glass, a zirconia-based material and an electrically conducting material. The zirconia-based material contains at least stabilized zirconia.

6 Claims, 3 Drawing Sheets

SPARK PLUG AND RESISTOR MATERIAL FOR SPARK PLUG

CROSS-REFERENCE TO RELATED APPLICATION

This application is based on and claims the benefit of priority from earlier Japanese Patent Application No. 2018-173158 filed Sep. 17, 2018, the description of which is incorporated herein by reference.

BACKGROUND OF THE INVENTION

Technical Field

The present disclosure relates to a spark plug and a resistor material for a spark plug.

Related Art

A spark plug is used as ignition means in an internal combustion such as an engine of an automobile. The spark plug has a resistor between a center electrode and a terminal fitting.

A spark plug including a resistor between a center electrode and a terminal fitting, the resistor containing glass, $ZrO_2$, an electrical conducting material and a metal is known.

SUMMARY

In an aspect of the present disclosure, a spark plug is provided, the spark plug including a resistor, the resistor containing a zirconia-based material, and the zirconia-based material containing at least stabilized zirconia.

Note that reference signs in brackets described in the claims and the summary indicate correspondence relationship with specific means described in the embodiment which will be described later and do not limit a technical scope of the present disclosure.

DETAILED DESCRIPTION OF THE PREFERRED EMBODIMENTS

Figure 1:
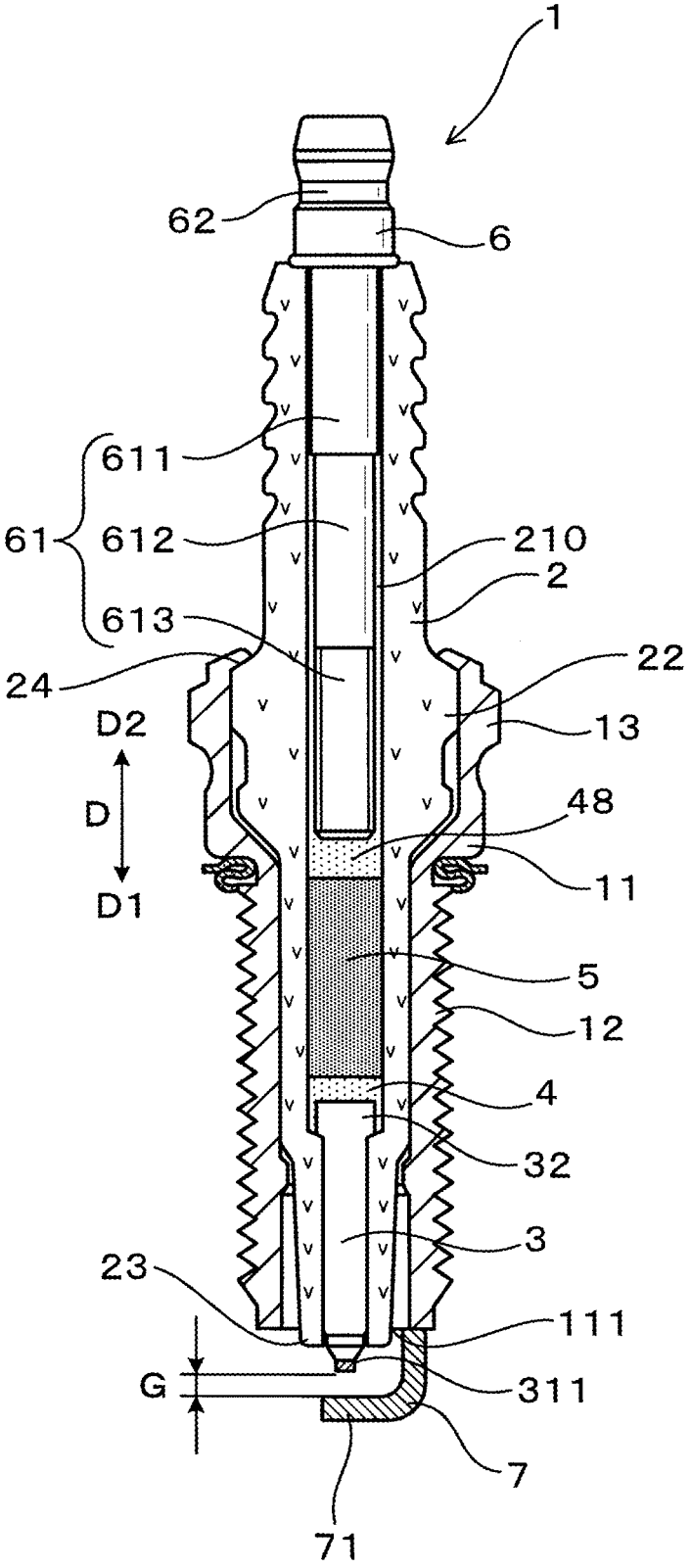
FIG. 1 is a longitudinal cross-sectional view illustrating an overall structure of a spark plug according to an embodiment of the present disclosure.

The inventor of the present disclosure has studied a spark plug which is capable of further improving load life performance, and a resistor material for a spark plug to be used for the spark plug.

In recent years, to achieve fuel saving, measures for improving a compression ratio in an internal combustion have been taken. As an influence of this, on the spark plug side, a discharge voltage upon ignition rises. If the discharge voltage rises, an electrically conducting material in the resistor is oxidized due to increase in a heating temperature caused by an increase in current, and a phenomenon occurs that a resistance value of the resistor increases. If the resistance value increases, it is difficult to improve the load life performance.

Concerning this point, in WO2010/052875A1, oxidation of the electrically conducting material is suppressed by adding a metal in the resistor and preferentially oxidizing the metal, so as to improve the load life performance of the spark plug. However, such a method does not eliminate any oxygen supply source which causes oxidization of the electrically conducting material. Therefore, in a high-load environment in which the discharge voltage further rises, because the heating temperature rises in accordance with increase in a capacitive discharge current, and there is a high possibility that oxidization of the electrically conducting material may proceed, it is difficult to obtain a sufficient effect of extending the load life.

The present disclosure has been made in view of such a problem, and is directed to providing a spark plug which is capable of further improving load life performance, and a resistor material for a spark plug to be used for the spark plug.

In an aspect of the present disclosure, a spark plug is provided, the spark plug including a center electrode, a terminal fitting, and a resistor disposed between the center electrode and the terminal fitting, the resistor containing glass, a zirconia-based material and an electrically conducting material, and the zirconia-based material containing at least stabilized zirconia.

Further, in another aspect of the present invention, a resistor material for a spark plug is provided, the resistor material for a spark plug containing glass, a zirconia-based material and an electrically conducting material, and the zirconia-based material contains at least stabilized zirconia.

In a conventional spark plug, the zirconia-based material in the resistor is formed with $ZrO_2$. In such a spark plug, as a result of the resistor generating heat by spark discharge currents, oxides in the glass react with $ZrO_2$, so that oxygen is discharged, and the electrical conductivity of the resistor is reduced due to the discharged oxygen being combining with electrically conducting materials, which result in increase in the resistance value.

In contrast, the above-described spark plug according to the present disclosure contains the above-described components, and the zirconia-based material in the resistor contains at least the stabilized zirconia. That is, the above-described spark plug already contains stabilized zirconia in the resistor in an initial stage before the spark plug is used. Because oxides of a stabilizing agent are dissolved in a solid solution state in the stabilized zirconia from the beginning, solid solution reaction of the oxides derived from glass is less likely to occur. Therefore, the above-described spark plug, in which the above-described discharging of oxygen is suppressed, avoids the above-described problems in a more fundamental way than the conventional spark plug. Accordingly, according to the above-described spark plug, it is possible to realize further improvement of load life performance.

A spark plug and a resistor for a spark plug according to the present disclosure will be described below with reference to the drawings on a basis of a preferred embodiment. Note that a size of each member in the drawings is emphasized as appropriate to facilitate explanation, and does not indicate an actual size and an actual ratio between members. Further, in the present specification and the drawings, repeated description will be omitted while the same reference numerals will be assigned to components having substantially the same functions and configurations.

A spark plug 1 according to an embodiment of the present disclosure will be described below using FIG. 1 and FIG. 2. The spark plug 1 according to the present embodiment illustrated in FIG. 1 is attached to an internal combustion, and is used to ignite a mixture gas, with which the inside of the internal combustion is filled, by causing spark discharging. As illustrated in FIG. 1, the spark plug 1 of the present embodiment includes a resistor 5 between a center electrode 3 and a terminal fitting 6. The resistor 5 will be described in detail below first, and then, an overall configuration of the spark plug 1 will be described.

The resistor 5 suppresses occurrence of radio noise due to spark discharging of the spark plug 1 in the spark plug 1. In the spark plug 1, the resistor 5 contains glass 51, a zirconia-based material 52 and an electrically conducting material 53 as illustrated in FIG. 2.

Figure 2:
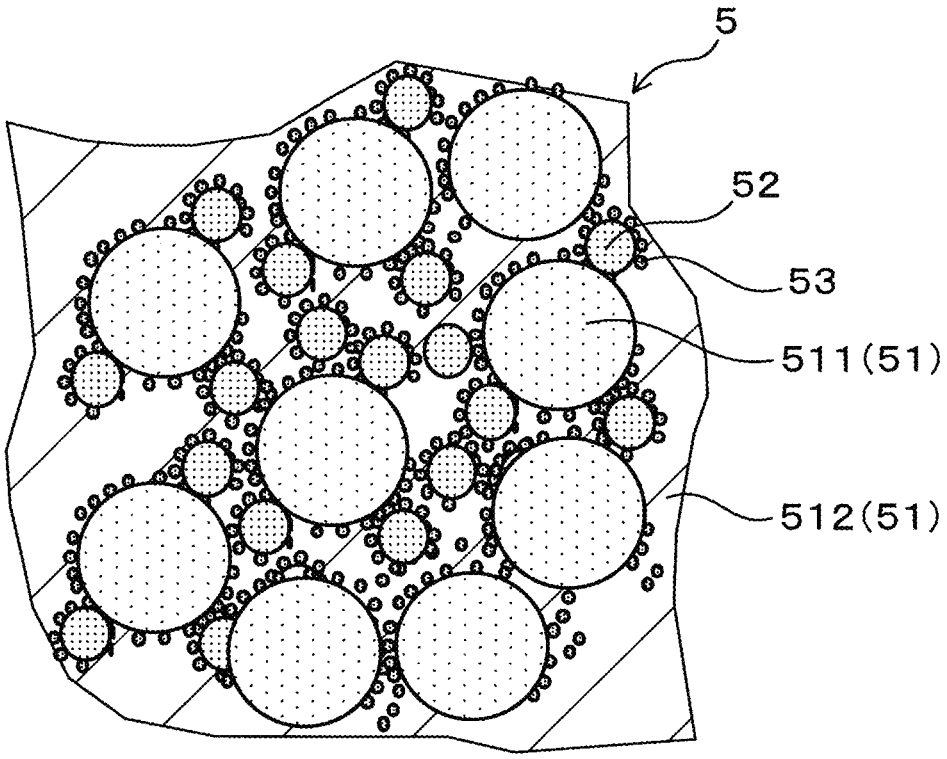
FIG. 2 is an explanatory diagram schematically illustrating part of a microstructure of a resistor of the spark plug according to an embodiment of the present disclosure illustrated in FIG. 1.
Figure 3:
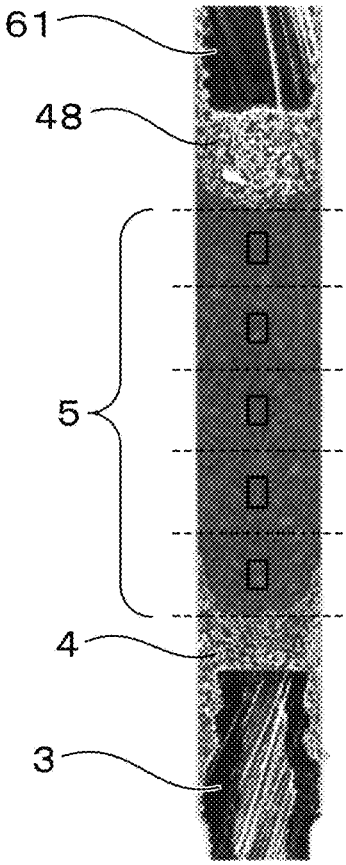
FIG. 3 is an explanatory diagram for explaining a method for confirming presence of stabilized zirconia in the resistor in experimental examples.

Note that FIG. 2 illustrates an example where the glass 51 is formed with glass particles 511 and a portion 512 in which part of the glass particles 511 melts and solidifies. As the glass 51, generally, glass containing one or more types of oxides such as CaO, MgO and $Al_2O_3$ is often used. These oxides are oxides which easily dissolve in zirconia ($ZrO_2$) in a solid solution state upon heat generation by energization. Therefore, in the spark plug 1, the above-described solid solution reaction is suppressed by using the zirconia-based material 52 containing at least stabilized zirconia.

Note that examples of the glass 51 can include, for example, soda-lime glass, borosilicate glass, silica glass, or the like, and borosilicate glass is usually employed. Further, the glass 51 may contain one or more of elements such as B, Si, Ba, Ca, Sn, Ti, Al and Mg.

Further, content of the glass 51 in the resistor 5 is, although not particularly limited, for example, equal to or greater than 60 mass % and equal to or less than 85 mass %, and, preferably, equal to or greater than 70 mass % and equal to or less than 80 mass %.

The zirconia-based material 52 contains at least stabilized zirconia. Further, the zirconia-based material 52 optionally contains zirconia in addition to the stabilized zirconia. Note that, in the present specification, the term "stabilized zirconia" is used as concept including partially stabilized zirconia in which a stabilized portion and unstable portion are mixed, as well as stabilized zirconia in a narrow sense, in which a crystal structure is stabilized with a stabilizing agent.

In the zirconia-based material 52, since the stabilized zirconia contains oxides of a stabilizing agent dissolved in a solid solution state in advance, solid solution reaction of oxides derived from the glass 51 is less likely to occur. Therefore, in the spark plug 1, discharge of oxygen derived from the zirconia-based material 52 due to reaction with the glass 51 is suppressed. Therefore, the load life performance of the spark plug 1 is improved compared to that of the conventional spark plug.

In the resistor 5 containing the zirconia-based material 52 at least containing the stabilized zirconia, whether or not the stabilized zirconia is contained is determined in an initial stage before the spark plug 1 is used, that is, at the spark plug 1 before use (new).

Specifically, the resistor 5 in the spark plug 1 before use is divided in half along an axial direction D of the spark plug 1. A cross-section of the resistor 5 divided in half is divided into five areas along a direction perpendicular to the axial direction D of the spark plug (along a radial direction of the resistor 5), and a central portion of each area is analyzed through micro X-ray diffraction analysis. Then, presence of the stabilized zirconia in each area is confirmed from a peak position. At this time, if the stabilized zirconia is detected even from one area, it is determined that the resistor 5 contains the stabilized zirconia. Note that, in a case where the stabilized zirconia is detected from a plurality of areas in a new spark plug 1, the stabilized zirconia is dispersed more uniformly over the resistor 5, so that improvement of load life performance can be achieved more easily. In terms of ease in achieving improvement in the load life performance, or the like, in the resistor 5, the stabilized zirconia is present preferably in two or more areas, more preferably in three or more areas, further more preferably in four or areas, and most preferably in five areas.

The zirconia-based material 52 can contain the stabilized zirconia of equal to or greater than 30 mass %. According to such a zirconia-based material 52, it becomes possible to extend a load life even in a more severe accelerated test which will be described later, on a basis of a resistor load life test of "internal combustion—spark plug" of JIS B8031.

In terms of an effect of extending a load life, or the like, the zirconia-based material 52 contains the stabilized zirconia of, preferably, equal to or greater than 35 mass %, more preferably, 40 mass %, still more preferably, 45 mass %, further more preferably, 50 mass %, yet more preferably, 55 mass %, and particularly preferably, 60 mass %. According to the zirconia-based material 52 containing the stabilized zirconia of equal to or greater than 60 mass %, even when a spark is struck 1.5 times of the number of times of ignition specified in the above-described resistor load life test, it is possible to extent the load life to equal to or longer than 56 hours.

Further, in a case where the zirconia-based material 52 essentially consists of the stabilized zirconia, more preferably consists of the stabilized zirconia (the zirconia-based material 52 is 100% formed with the stabilized zirconia), the load life is more likely to be extended, and trouble of mixing the stabilized zirconia and zirconia upon manufacturing is avoided, so that the spark plug 1 with excellent manufacturability can be obtained. On the other hand, in a case where the zirconia-based material 52 is formed with the stabilized zirconia and zirconia, it is possible to improve load life performance while suppressing increase in cost due to the stabilized zirconia.

Content (mass %) of the stabilized zirconia in the zirconia-based material 52 is calculated as described below. That is, content (mass %) of the stabilized zirconia in the zirconia-based material 52 can be calculated using the following expression from a compounding ratio upon manufacturing.

$$100\times(\text{mass (g) of the stabilized zirconia})/(\text{mass (g) of the zirconia-based material 52})$$

Note that, in a case where the zirconia-based material 52 consists of the stabilized zirconia and $ZrO_2$, the above expression becomes as follows.

$$100\times(\text{mass (g) of the stabilized zirconia})/(\text{mass (g) of the stabilized zirconia}+\text{mass (g) of } ZrO_2)$$

As described above, while the above-described mass ratio of the mass (g) of the zirconia ($ZrO_2$) and the mass (g) of the stabilized zirconia in the resistor 5 can be adjusted by the compounding ratio upon manufacturing, the mass ratio can be quantified through X-ray diffraction analysis described below from the manufactured spark plug 1. That is, the spark plug 1 is made in a half-sectional state including a central axis of the resistor 5, X-rays are radiated on an area including the glass particles (512), the zirconia-based material (52) and the electrically conducting material (53), and types and contents (g) of zirconia are obtained from detected peak positions and a heights of the diffracted X-rays. As an X-ray diffraction analysis device, SmartLab manufactured by Rigaku Corporation can be used, and the above-described content (mass %) can be obtained with following measurement conditions:

X-ray tube: CuKα,
a tube voltage: 45 kV,
a tube current: 200 mA,
a counting period: 1 degree/min, and
a step width: 0.02, and
an entrance slit of a 50 μmϕ collimator is employed.

In the stabilized zirconia, for example, oxides of one or more types of elements selected from elements such as Ca, Si, Sc, Y, Ce, Mg and Al dissolves in solid solution state as a stabilizing agent. In the stabilized zirconia, specifically, at least one type selected from an oxide of Y (such as $Y_2O_3$), an oxide of Ce (such as $CeO_2$), an oxide of Mg (such as MgO), an oxide of Ca (such as CaO) and an oxide of Al (such as $Al_2O_3$) is preferably dissolved in solid solution state. According to this configuration, compared to a case where the zirconia-based material 52 in the resistor 5 does not contain the stabilized zirconia, and the zirconia-based material 52 is 100% zirconia ($ZrO_2$), it is possible to ensure further improvement of load life performance.

The stabilized zirconia contains the above-described stabilizing agent of, for example, equal to or greater than 1 mol % and equal to or less than 35 mol %, preferably, equal to or greater than 2 mol % and equal to or less than 25 mol % with respect to Zr on a basis of oxidized elements.

Further, the resistor 5 contains the zirconia-based material of, for example, equal to or greater than 10 mass % and equal to or less than 35 mass %, preferably, equal to or greater than 15 mass % and equal to or less than 30 mass %.

The electrically conducting material 53 provides a passage of charges in the resistor 5, and provides necessary conductivity to the resistor 5. The electrically conducting material 53 is not particularly limited, and examples of the electrically conducting material 53 can include carbon, or the like.

Further, the resistor 5 contains the electrically conducting material 53 of, for example, equal to or greater than 0.5 mass % and equal to or less than 10 mass %, preferably, equal to or greater than 1 mass % and equal to or less than 7 mass %.

As far as the spark plug 1 includes the above-described resistor 5 between the center electrode 3 and the terminal fitting 6, the spark plug 1 can employ a publicly known configuration as appropriate for configurations of other portions. While an example of an overall configuration of the spark plug 1 will be described below, the configuration is not limited to this.

The spark plug 1 illustrated in FIG. 1 has a long shape. The spark plug 1 is used for an internal combustion. In the present embodiment, the internal combustion is, for example, an engine for an automobile, and the spark plug 1 is attached to an attachment hole of a cylinder head toward an engine combustion chamber which is not illustrated with an attachment bracket 11 which will be described later. Note that, in the present disclosure, the internal combustion engine is not limited to an internal combustion engine for an automobile, and can be used in transportation equipment such as an automobile, a ship, a motorcycle and an airplane, a generator, or the like. Specific examples of the internal combustion can include, for example, a positive-displacement internal combustion such as a reciprocating engine (for example, a gasoline engine, a diesel engine), and a rotary engine, and a velocity-type internal combustion engine such as a gas turbine engine and a jet engine, or the like.

Note that a side which projects inside the combustion chamber in an axial direction D of the spark plug 1 will be referred to as a tip side D1, and the opposite side will be referred to as a distal end side D2. That is, a lower side in FIG. 1 is the tip side D1, and an upper side is the distal end side D2.

The spark plug 1 includes an attachment bracket 11, an insulating glass 2, a center electrode 3, conductive glass seal portions 4 and 48, the above-described resistor 5, a terminal fitting 6 and a grounding electrode 7. The conductive glass seal portions 4 and 48 include a first conductive glass seal portion 4 provided between the distal end side D2 of the center electrode 3 and the tip side D1 of the resistor 5, and a second conductive glass seal portion 48 provided between the distal end side D2 of the resistor 5 and the tip side D1 of the terminal fitting 6.

The cylindrical attachment bracket 11 holds the insulating glass 2 inside. The insulating glass 2 holds the center electrode 3 on the tip side D1 inside a shaft hole 210, and holds a shaft portion 61 of the terminal fitting 6 on the distal end side inside the shaft hole 210. The first conductive glass seal portion 4 fixes the distal end side D2 of the center electrode 3 inside the shaft hole 210 of the insulating glass 2. The second conductive glass seal portion 48 fixes the tip side D1 of the terminal fitting 6 inside the shaft hole 210 of the insulating glass 2.

The grounding electrode 7 faces the center electrode 3 on the tip side D1 of the shaft hole 210 of the insulating glass 2. The resistor 5 is disposed between the center electrode 3 and the terminal fitting 6 inside the shaft hole 210 of the insulating glass 2. In the spark plug 1, the insulating glass 2 and the center electrode 3 are coaxially disposed. The respective parts constituting the spark plug 1 will be described in detail below.

The attachment bracket 11 has a cylindrical shape and holds the insulating glass 2 inside. The attachment bracket 11 has an attachment screw portion 12 on an outer periphery on the tip side D1 in the axial direction D and has a large diameter portion 13 having a larger diameter than that of the attachment screw portion 12 on the distal end side D2.

Inside of the large diameter portion 13 of the attachment bracket 11, a large diameter portion 22 provided at an intermediate portion of the insulating glass 2 is stored and held, and a distal end edge portion 24 of the large diameter portion 22 is swaged and fixed so as to achieve air sealing. The attachment bracket 11 is, for example, formed with an iron alloy material such as carbon steel.

The insulating glass 2 is held inside the cylindrical attachment bracket 11. The insulating glass 2 has a shaft hole 210 which penetrates in the axial direction D. The center electrode 3 is held inside the shaft hole 210 of the insulating glass 2. A tip portion 23 of the insulating glass 2 projects toward the tip side D1 from a tip opening 111 of the attachment bracket 11. The insulating glass 2 is formed with insulating ceramics such as alumina.

The center electrode 3 has a long shape which extends in the axial direction D of the spark plug 1. The center electrode 3 is held on the tip side D1 inside the shaft hole 210 of the insulating glass 2. The center electrode 3 has a distal end portion 32 having a large diameter, and the distal end portion 32 is supported on a tapered stepped face 211 provided on an inner periphery of the shaft hole 210 of the insulating glass 2. Meanwhile, the center electrode 3 has a tip portion 311 having a tapered shape, and the tip portion 311 projects toward the tip side D1 further than the tip portion 23 of the insulating glass 2.

The grounding electrode 7 has a plate shape which bends so that the whole cross-section has an L-shape (specifically, an inverted L-shape in FIG. 1), and the distal end side D2 of the grounding electrode 7 is bonded and fixed on a tip face of the attachment bracket 11. The grounding electrode 7 extends in the axial direction D on a side of the center electrode 3, and the tip portion 71 bends inward in a radial direction and faces the tip portion 311 of the center electrode 3. By this means, a spark discharging gap G is formed between the tip portion 311 of the center electrode 3 and the tip portion 71 of the grounding electrode 7.

The center electrode 3 and the grounding electrode 7 are, for example, formed using a metal material such as an Ni-base alloy containing Ni (nickel) as a base, as a base material. The center electrode 3 and the grounding electrode 7 may be formed to have a core formed with a metal excellent in thermal conductivity, for example, a metal material such as Cu (copper) or a Cu alloy, or the like, inside the electrodes. On faces of the tip portion 311 of the center electrode 3 and the tip portion 71 of the grounding electrode 7 which face each other, for example, a noble metal chip formed in a cylindrical shape is bonded through welding, or the like. Examples of the noble metal material can include, for example, Pt (platinum), Ir (iridium), Rh (rhodium), or the like, and a noble metal or a noble metal alloy containing at least one type selected from these noble metals as base can be used.

The terminal fitting 6 includes a terminal portion 62 having a large diameter and a shaft portion 61 having a smaller diameter than the diameter of the terminal portion 62. The shaft portion 61 includes a distal end portion 611 on the terminal portion 62 side and a main shaft portion 612 on the tip side D1. The main shaft portion 612 includes an outer-periphery groove portion 613 formed by performing screw processing or groove processing on an outer periphery on the tip side D1. The outer-periphery groove portion 613 enhances fixing to the conductive glass seal portion 48 between the outer-periphery groove portion 613 and the resistor 5.

In FIG. 1, the shaft portion 61 having a small diameter of the terminal fitting 6 is stored inside the shaft hole 210 of the insulating glass 2, and pressurizes the resistor 5 via the conductive glass seal portion 48 upon the terminal fitting 6 is assembled to the insulating glass 2. The terminal portion 62 having a large diameter of the terminal fitting 6 projects toward the distal end side D2 from a distal end opening of the shaft hole 210 of the insulating glass 2, and is connected to a high-voltage supply which is not illustrated. The high-voltage supply is, for example, an ignition coil which generates a high voltage for ignition by being connected to an in-vehicle battery, and is connected to a control device which is not illustrated. Note that the terminal fitting 6 is sometimes referred to as a stem.

Inside the shaft hole 210 of the insulating glass 2, the resistor 5 is provided between the shaft portion 61 of the terminal fitting 6 and the center electrode 3 via the conductive glass seal portions 4 and 48. The resistor 5 is a cylindrical member, whose electrical resistance is adjusted to a predetermined value. The resistor 5 has a function of electrically connecting the center electrode 3 and the terminal fitting 6 and absorbing radio noise.

The first conductive glass seal portion 4 is provided between the resistor 5 and the center electrode 3. Further, the second conductive glass seal portion 48 is provided between the resistor 5 and the terminal fitting 6.

The first conductive glass seal portion 4 and the second conductive glass seal portion 48 are formed with conductive bonding glass, and the bonding glass is, for example, formed with copper glass formed by mixing copper powder in glass. By this means, a conductive path reaching the center electrode 3 from an external high-voltage supply by way of the terminal fitting 6, the second conductive glass seal portion 48, the resistor 5, and the first conductive glass seal portion 4 is formed, and a high voltage is applied between the center electrode 3 and the grounding electrode 7, and thereby a spark discharging occurs.

At the spark plug 1 according to the present embodiment, the zirconia-based material 52 in the resistor 5 contains at least stabilized zirconia. That is, the spark plug 1 already contained stabilized zirconia in the resistor 5 in an initial stage before the spark plug 1 is used. Because, in the stabilized zirconia, oxides of the stabilizing agent were dissolved in solid solution state from the beginning, solid solution reaction of oxides derived from glass is less likely to occur. Therefore, in the spark plug 1, discharging of oxygen by reaction between oxides in the glass 51 and $ZrO_2$ as a result of the resistor 5 generating heat by spark discharging currents is suppressed. Accordingly, according to the spark plug 1, it is possible to further improve load life performance.

A resistor material for the spark plug according to the present embodiment will be described next. The resistor material for the spark plug according to the present embodiment is used as a constituent material of the resistor of the spark plug according to the present embodiment. The resistor material for the spark plug comprises glass, the zirconia-based material and the electrically conducting material, and the above-described zirconia-based material contains at least stabilized zirconia.

Because types and content of the glass, the zirconia-based material and the electrically conducting material contained in the resistor material for the spark plug are the same as those of the glass 51, the zirconia-based material 52 and the electrically conducting material 53 described above, detailed description will be omitted. Note that all of the above-described materials are normally contained in the resistor material for the spark plug as powder.

Further, the resistor material for the spark plug may contain a binder. The binder contributes to bonding of the respective materials in the resistor material for the spark plug. While the binder is not particularly limited, examples of the binder can include, for example, sugar such as sucrose, lactose, maltose, raffinose, glycose, xylol, dextrin and methylcellulose, polyol such as ethylene glycol, glycerin, propylene glycol, polyethyleneglycol and polyvinyl alcohol, or the like, and one or more types among these can be used. Content of the binder in the resistor material for the spark plug is, although not particularly limited, for example, equal to or greater than 0.5 mass % and equal to or less than 10 mass %, preferably, equal to or greater than 1 mass % and equal to or less than 7 mass %.

The resistor material for the spark plug is, for example, pressed and fitted between the center electrode 3 and the terminal fitting 6 described above, and becomes the resistor 5 of the spark plug 1 optionally through a sintering process.

EXPERIMENTAL EXAMPLES

Experimental Example 1

—Preparation of Resistor Material—

A plurality of types of resistor materials were prepared by sufficiently mixing glass powder of borosilicate glass of 77 pts. mass as a welding material, a zirconia-based material of 20 pts. mass as a dispersant material, carbon black of 2 pts. mass as an electrically conducting material, and dextrin of 1 pts. mass as a binder so as to achieve a uniform state. The zirconia-based material consists of $ZrO_2$, or of calcia stabilized zirconia ($Ca_{0.2}Zr_{0.8}O_{1.8}$) and $ZrO_2$, or of calcia stabilized zirconia. Note that the zirconia-based material consisting of $ZrO_2$ was prepared for comparison. Further, in the zirconia-based materials consisting of calcia stabilized zirconia and $ZrO_2$, by changing a mass ratio of the calcia stabilized zirconia and $ZrO_2$, a mass proportion of the calcia stabilized zirconia in a total mass of the zirconia-based material was adjusted.

—Preparation of Test Body—

After a center electrode was inserted inside a shaft hole of an insulating glass, the shaft hole was filled with a conductive glass seal material and preliminarily compressed. Then, the shaft hole was sequentially filled with a predetermined resistor material and the conductive glass seal material in a similar manner and preliminarily compressed. Then, a terminal fitting was inserted into the shaft hole. Then, after this was heated in a furnace for a fixed period, the terminal fitting was pressed and fitted and welded. By this means, each test body was obtained.

Figure 4:
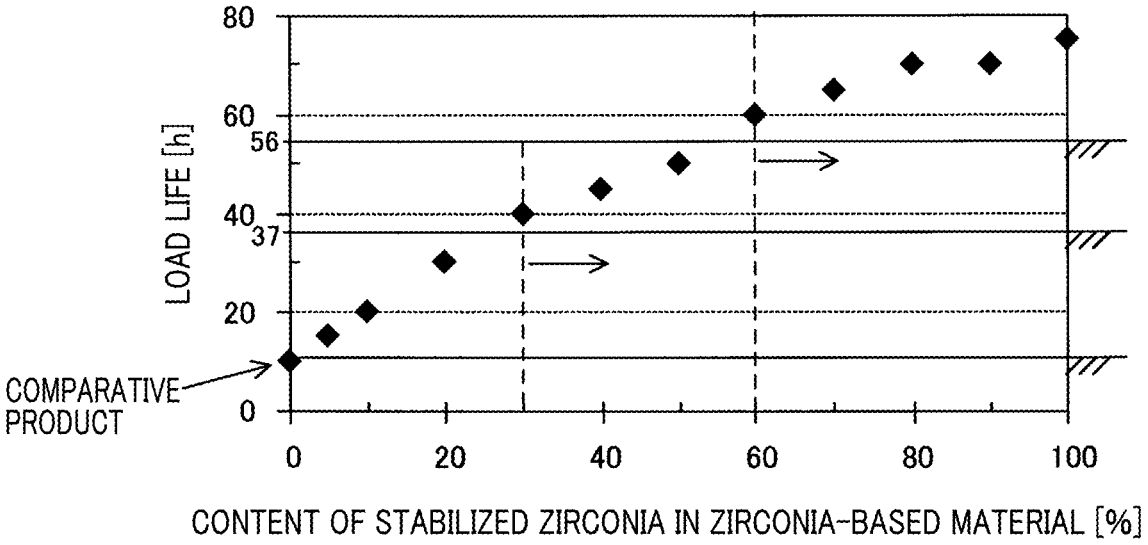
FIG. 4 is a graph illustrating relationship between content of the stabilized zirconia in a zirconia-based material and a load life obtained in the experimental examples.

A resistor in the obtained each test body (not in use) was divided into five areas as illustrated in FIG. 4, and each area was analyzed through micro X-ray diffraction analysis. Note that a portion enclosed with a rectangle in FIG. 4 is an analysis position. As a result, in all the test bodies in which the calcia stabilized zirconia is added to the zirconia-based material, presence of calcia stabilized zirconia was confirmed in one or more areas (specifically, a plurality of areas). Note that, in the test body for comparison in which the zirconia-based material was formed with $ZrO_2$ without calcia stabilized zirconia being added to the zirconia-based material, calcia stabilized zirconia was not detected from any area.

—Evaluation of Test Bodies—

A load life test was performed on the respective test bodies on load life test conditions of the spark plug specified in JIS B8031 (hereinafter, sometimes referred to as "JIS conditions") and on conditions which are made more severe on the basis of the JIS conditions (hereinafter, sometimes referred to as "JIS based accelerated conditions"). Note that the JIS conditions are such that the number of times of ignition is $1.3\times10^7$, a frequency is not specified, a discharge voltage is 20±5 kV, a temperature is not specified, and standards are set such that a change rate of a resistance value is equal to or less than ±30%. In contrast, in the JIS based accelerated conditions, the number of times of ignition is set at a period until the change rate of the resistance value reaches ±30% on the basis of the "change rate of the resistance value is equal to or less than ±30%" in the JIS standard conditions, the frequency is 100 Hz, the discharge voltage is 40 kV, and the temperature is 350° C., and the standards are set such that the change rate of the resistance value is equal to or less than ±30%. Note that, in the above-described JIS based accelerated conditions, conditions for the discharge voltage and the temperature are set to be more severe than those in the JIS conditions on assumption of increase in the discharge voltage upon ignition in the future. In the present experimental example, a state where the change rate of the resistance value reaches ±30% is defined as a load life.

FIG. 4 illustrates relationship between content of the stabilized zirconia in the zirconia-based material and a load life. As illustrated in FIG. 4, it can be seen that as the content of the stabilized zirconia in the zirconia-based material in the resistor increases, the load life becomes longer. Further, by setting content of the stabilized zirconia in the zirconia-based material at equal to or greater than 30 mass %, even under the JIS based accelerated conditions, the load life can be easily extended to equal to or longer than 37 hours which is a load life corresponding to the number of times of ignition in the JIS standards. Further, by setting the content of the stabilized zirconia in the zirconia-based material at equal to or greater than 60 mass %, even under the JIS based accelerated conditions, the load life can be easily extended to equal to or longer than 56 hours which is a load life corresponding to 1.5 times of the number of times of ignition in the JIS standards.

The above-described result could be obtained for the following reasons. In the comparative product, the resistor generated heat at equal to or higher than 1200° C. by Joule heat generation upon energization, and, at this time, with CaO contained in glass dissolved in $ZrO_2$ in solid solution state for $Ca_{0.2}Zr_{0.8}O_{1.8}$ as an insulating material to be generated, oxygen was discharged in association with generation of $Ca_{0.2}Zr_{0.8}O_{1.8}$, the discharged oxygen reacted with carbon, so that carbon which was an electrically conducting material was oxidized and disappeared, and as a result, the resistance value increased and a load life became insufficient. In contrast, in a case where the calcia stabilized zirconia was added to the zirconia-based material, CaO derived from glass was less likely to dissolve in the calcia stabilized zirconia in solid solution state, so that it was possible to suppress generation of $Ca_{0.2}Zr_{0.8}O_{1.8}$ as an insulating material. As a result, in this case, it was possible to further improve load life performance.

Note that, in the above-described experimental example 1, as a result of similar evaluation being performed in a case where a compounding ratio of the zirconia-based material upon preparation of the resistor material was set at 15 pts. mass and a compounding ratio of the glass powder was set at 82 pts. mass, and in a case where the compounding ratio of the zirconia-based material was set at 25 pts. mass, and the compounding ratio of the glass powder was set at 72 pts. mass, results similar to those described above could be obtained.

Experimental Example 2

Each test body was manufactured in a similar manner to experimental example 1 except that the zirconia-based material was formed with predetermined stabilized zirconia, and evaluation was performed. Note that the stabilized zirconia used is stabilized using a stabilizing agent of $Y_2O_3$, $CeO_2$, CaO, MgO or $Al_2O_3$.

Figure 5:
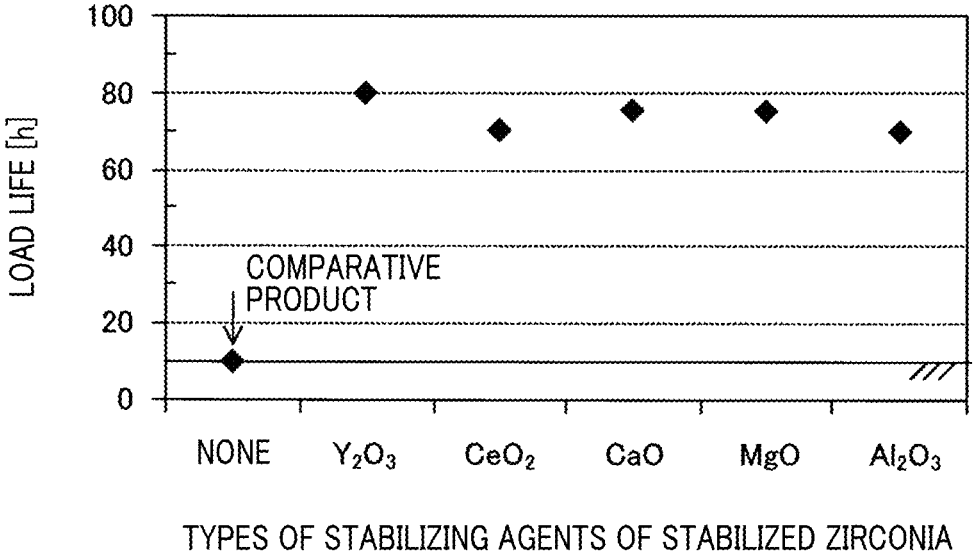
FIG. 5 is a graph illustrating relationship between types of stabilizing agents of the stabilized zirconia and a load life obtained in the experimental examples.

FIG. 5 illustrates the relationship between types of stabilizing agents of the stabilized zirconia and a load life. According to FIG. 5, it could be confirmed that an effect of further extending load life performance could be obtained regardless of types of stabilizing agents.

The present disclosure is not limited to the above-described embodiment and experimental examples, and can be modified in various manners within a scope not deviating from the gist of the present disclosure.

What is claimed is:

1. A spark plug, comprising:

a center electrode;

a terminal fitting; and a resistor disposed between the center electrode and the terminal fitting, wherein the resistor contains glass, a zirconia-based material and an electrically conducting material, the zirconia-based material contains at least stabilized zirconia, and the stabilized zirconia contains at least one selected from an oxide of Y, an oxide of Ce, an oxide of Mg, an oxide of Ca and an oxide of Al in a solid solution state.

2. The spark plug according to claim 1, wherein the zirconia-based material contains the stabilized zirconia of equal to or greater than 30 mass percentage.

3. The spark plug according to claim 1, wherein the zirconia-based material consists of the stabilized zirconia.

4. A resistor material for a spark plug, comprising:

glass;

a zirconia-based material; and an electrically conducting material, wherein the zirconia-based material contains at least stabilized zirconia, and the stabilized zirconia contains at least one selected from an oxide of Y, an oxide of Ce, an oxide of Mg, an oxide of Ca and an oxide of Al in a solid solution state.

5. The spark plug according to claim 1, wherein the resistor contains electrically conducting material of greater than or equal to 0.5 mass percentage and less than or equal to 10 mass percentage.

6. The spark plug according to claim 5, wherein the electrical conducting material is greater than or equal to 1 mass percentage and less than or equal to 7 mass percentage.

* * * * *